US006824856B2

(12) United States Patent
Jones

(10) Patent No.: US 6,824,856 B2
(45) Date of Patent: Nov. 30, 2004

(54) PROTECTIVE PACKAGING SHEET

(75) Inventor: Ian Karl Jones, Gwent (GB)

(73) Assignee: ITW Limited, Swansea (GB)

( * ) Notice: Subject to any disclaimer, the term of this patent is extended or adjusted under 35 U.S.C. 154(b) by 68 days.

(21) Appl. No.: 09/826,325

(22) Filed: Apr. 5, 2001

(65) Prior Publication Data

US 2001/0049007 A1 Dec. 6, 2001

(30) Foreign Application Priority Data

Apr. 6, 2000 (GB) ..... 0008538

(51) Int. Cl.[7] ..... B32B 3/00; B32B 5/00; B32B 3/12; B32B 81/02

(52) U.S. Cl. ..... 428/172; 428/98; 428/166; 428/178; 428/117; 428/158; 428/180; 428/187

(58) Field of Search ..... 428/166, 178, 428/172, 98, 117, 180, 158, 187; 206/522

(56) References Cited

U.S. PATENT DOCUMENTS

| | | | | | |
|---|---|---|---|---|---|
| 1,984,653 | A | * | 12/1934 | Palmer et al. | 404/44 |
| 2,978,006 | A | * | 4/1961 | Clemens | 156/210 |
| 3,575,781 | A | | 4/1971 | Perzely | |
| 3,903,342 | A | * | 9/1975 | Roberts, Jr. | 428/153 |
| 4,287,250 | A | * | 9/1981 | Rudy | 206/522 |
| 5,242,735 | A | * | 9/1993 | Blankenburg et al. | 428/116 |
| 5,273,361 | A | * | 12/1993 | Jillson | 383/109 |
| 5,340,638 | A | | 8/1994 | Sperner | |
| 5,692,607 | A | | 12/1997 | Brosmith et al. | |
| 5,830,558 | A | * | 11/1998 | Barnholtz | 428/154 |
| 5,871,607 | A | | 2/1999 | Hamilton et al. | |
| 5,894,045 | A | * | 4/1999 | Desrondiers | 428/174 |
| 5,928,770 | A | | 7/1999 | Quinones | |
| 5,983,598 | A | | 11/1999 | Quinones | |
| 6,254,965 | B1 | * | 7/2001 | McGuire et al. | 428/141 |

FOREIGN PATENT DOCUMENTS

| | | |
|---|---|---|
| FR | 1 312 665 | 4/1963 |
| GB | 1 118 607 | 7/1968 |

* cited by examiner

*Primary Examiner*—Rena L. Dye
*Assistant Examiner*—L. Ferguson
(74) *Attorney, Agent, or Firm*—Lowe Hauptman Gilman & Berner, LLP

(57) ABSTRACT

A protective packaging sheet which is particularly suitable for packaging heavy loads such as coils of sheet steel. The packaging sheet is formed from a plastics sheet material having inherently relatively low compressions strength and resistance to impact forces and bending. These mechanical properties are vastly improved in the embossed packaging sheet. At least one of the surfaces of the sheet material is provided with shaped protuberances juxtaposed with adjacent shaped protuberances to provide a gap around each shaped protuberance. The shaped protuberances are arranged in such a way that all straight lines projected onto the surface cut through the shaped protuberances in addition to the gaps.

34 Claims, 3 Drawing Sheets

PROTECTIVE PACKAGING SHEET

FIELD OF THE INVENTION

This invention relates to packaging materials and in particular, though not solely, to embossed sheet material used in packaging heavy loads such as large metal coils or rolls or stacks of rectangular cut sheet metal.

BACKGROUND OF THE INVENTION

In order to avoid or minimise damage to heavy loads such as cold rolled steel coils during transportation and storage, specialised packaging solutions are required. In the case of steel coils, the extreme weight (up to around 20 tonnes) over a surface contact area as small as 0.5 $m^2$ makes it difficult to meet the desirable requirement of maintaining separation between the ground and the steel to avoid corrosion during storage. The packaging material should also be puncture resistant, have a high impact strength and resistance to compression under the weight of a coil. It would also be beneficial for the packaging material to be recyclable, cheap to produce and manageable (light weight and easily worked into position around a coil).

Currently, there are a number of alternative materials used in packaging steel coils. Some manufacturers package their steel coils in steel or hard fibre hardboard, usually held together with steel straps. The steel coil may be (but is not always) shipped on a wooden pallet either with the axis of the coil vertical or horizontal. Some steel coils are wrapped in sheets of paper, such as kraft paper, plastics stretch wrap or a tear resistant plastic material (such as polyethylene or polypropylene) having one or more layers, sometimes with at least one layer being impregnated with a corrosion inhibitor (see for example U.S. Pat. No. 5,983,598). However these materials offer insufficient protection and padding beneath the steel. Laminated polyethylene/polypropylene (see for example U.S. Pat. No. 5,928,770) has also been suggested as a packaging material for steel coils however the manufacturing costs for this material would be prohibitive.

It is therefore an object of the present invention to provide a protective packaging sheet which goes at least some way towards overcoming the above disadvantages.

SUMMARY OF THE INVENTION

Accordingly, in a first aspect, the invention consists in a protective packaging sheet comprising:

front and rear surfaces, at least one of the surfaces having a repeating pattern therein, the repeating pattern consisting of shaped protuberances juxtaposed with adjacent shaped protuberances to provide a gap around each shaped protuberance, the shaped protuberances extending from the at least one of the surfaces and being positioned in such a way that all straight lines projected onto said surface of the sheet cut through the shaped protuberances in addition to the gaps.

Preferably the protective packaging sheet is embossed to provide the shaped protuberances.

Preferably the front and rear surfaces both include a repeating pattern with the rear surface pattern being the inverse of the front surface pattern.

Preferably the contact surface area of the front surface is substantially equal to the contact surface area of the rear surface.

Preferably the packaging sheet has three levels, the front surface, the rear surface and a middle level between the front and rear surfaces, the middle level comprising a surface of connecting webs connecting adjacent shaped protuberances.

Preferably some of the connecting webs extend in a direction lateral to the shaped protuberances and others extend in a direction substantially perpendicular to the lateral direction.

Preferably the shaped protuberances are substantially tessellatable.

Preferably the shaped protuberances are "T" shaped in plan.

Preferably the packaging sheet is formed from a flat sheet of thermoplastics material wherein the distance between the front and rear surfaces of the packaging sheet is less than or equal to about 5 times the thickness of the thermoplastics sheet from which it is formed.

Preferably the gaps between the shaped protuberances are filled with insulating foam.

Preferably a thin sheet is laminated to the furthermost projecting sections of either or both of the front and rear surfaces.

Preferably the shaped protuberances comprise a top surface protruding from the packaging sheet atop side walls which are rounded, bevelled or sloped relative to a direction perpendicular to the plane of the packaging sheet.

BRIEF DESCRIPTION OF THE DRAWINGS

Particular embodiments of the invention will now be described with reference to the accompanying drawings in which.

DETAILED DESCRIPTION OF THE PREFERRED EMBODIMENTS

Figure 1:
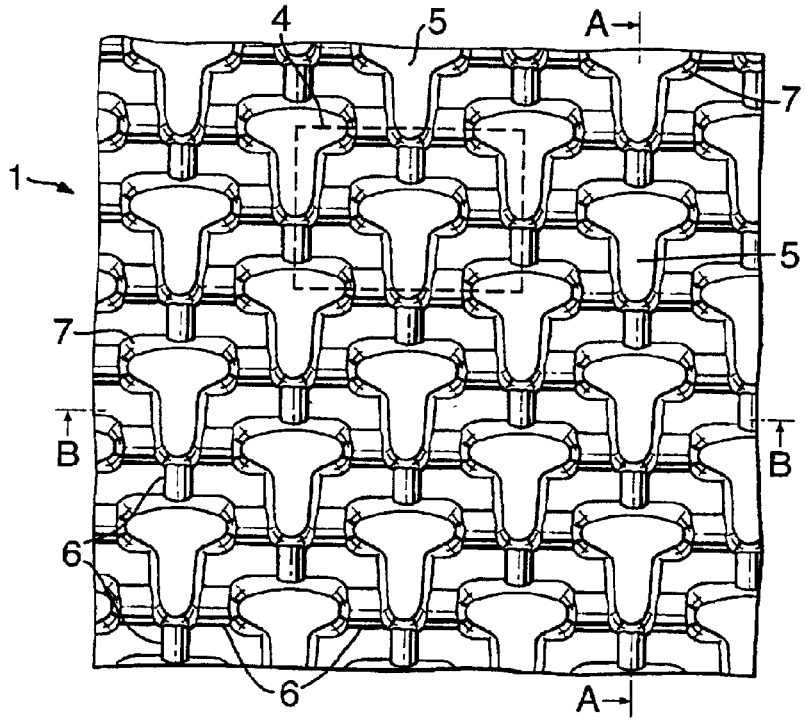
FIG. 1 is a plan view from above of a portion of the protective packaging sheet according to a particular embodiment of the present invention.
Figure 2:
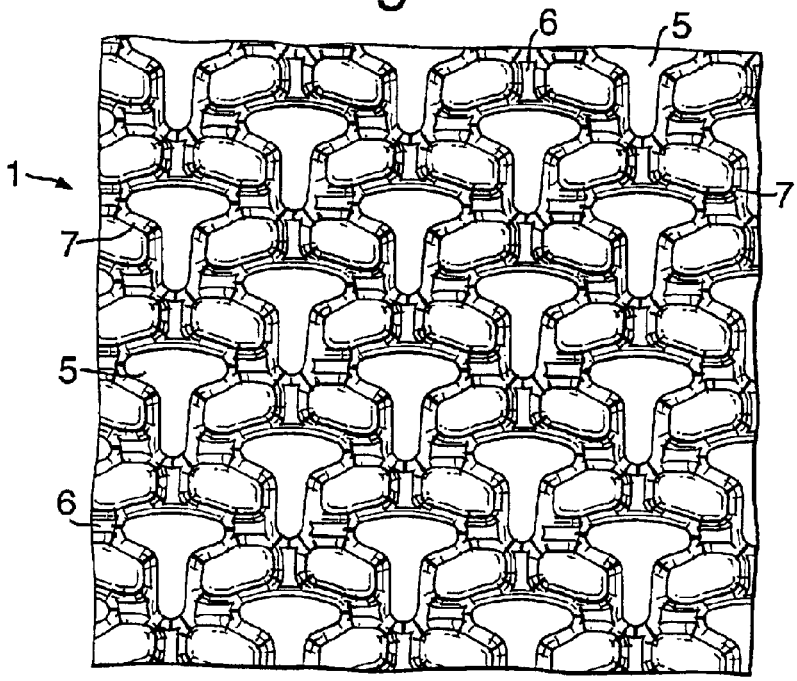
FIG. 2 is a plan view from below of the protective packaging sheet shown in FIG. 1.
Figure 3:
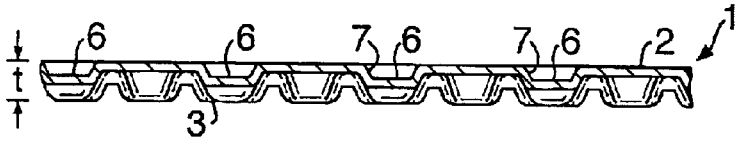
FIG. 3 is a cross-sectional side elevation of the protective packaging sheet of FIG. 1 through the line A—A.
Figure 4:
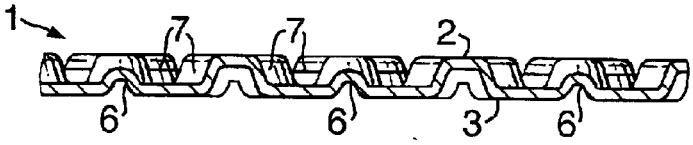
FIG. 4 is a cross-sectional side elevation of the protective packaging sheet of FIG. 1 through the line BB.

With reference to the drawings and in particular FIGS. 1 to 4, a portion of a protective packaging sheet 1 is shown. Preferably the packaging sheet is formed from a thermoplastics material such as low or high density polyethylene although polypropylene could also be used. As can be seen in FIGS. 3 and 4, the packaging sheet has a thickness (t) which is preferably the result of an embossing rolling process on an originally planar sheet, however it could be possible to form the packaging sheet in other known ways such as by vacuum forming or moulding.

The front surface 2 is visible in FIG. 1 while the rear surface 3 is visible in FIG. 2 although, preferably, the packaging sheet has no specific front or rear surface. The portion shown in FIGS. 1 to 4 includes a repeating pattern and an example of the repeat is enclosed within rectangle 4 in FIG. 1. It can be seen that the repeating pattern includes a shaped protuberance 5 in surface 2 and in the example shown, the shaped protuberance 5 is substantially "T" shaped, the backs of the "T"'s being visible in FIG. 2.

As shown in the drawings, the side walls 7 of the shaped protuberance 5 are preferably rounded, bevelled or sloped rather than being perpendicular to the sheet. This simplifies the production process but also effectively increases the strengthening effect provided by the shaped protuberances in the packaging sheet beyond that which would be expected due to their contact surface area (that is, the area of the bases of the shaped protuberances are larger than their contact surface area) and accordingly, the side walls 7 improve the ability of the packaging sheet to resist compression. In addition, because the side walls 7 protrude out beyond the contact surface of the shaped protuberances, the resistance to the formation of fold lines in the packaging sheet is increased because the fold lines must also progress up the side walls 7.

Gaps or spaces are provided around each shaped protuberances 5 where the plastics sheet is depressed down to the rear surface 3. Preferably the shaped protuberance 5 is a tessellatable (able to be tessellated) shape. The repeating pattern could also be made up of more than one differently shaped protuberance suitably positioned or made up of identical shaped protuberances oriented in different directions.

Although not essential, it has been found that the physical properties (for example resistance to bending and impact loads and increased rigidity) of the packaging sheet are improved by providing connecting webs 6 between adjacent shaped protuberances 5. The shaped protuberance 5 could also be considered to include the connecting webs. Effectively, the connecting webs resist bending of the packaging sheet by resisting compressive or tensile forces acting along them. Accordingly, it is preferred that some connecting webs be provided at least both in a lateral direction and also in a direction perpendicular to the lateral direction. It can be seen in the cross-sectional views of FIGS. 3 and 4 that the connecting webs extend only substantially midway between the front 2 and rear 3 surfaces and thereby form a middle level between the two surfaces.

As previously mentioned, the embodiment shown in FIGS. 1 to 4 has been designed so that it may be used with either surface contacting the load to be packaged. This avoids accidental incorrect usage of the packaging sheet and is possible because the contact surface area of the front and rear surfaces is about the same and has been achieved by the combination of the spacing, size and juxtaposition of the shaped protuberances 5. As the connecting webs 6 do not project out from the surface of the sheet as far as the "T" shaped protuberances, they do not contribute to the contact surface area of either front or rear surface.

The stiffness of the packaging sheet according to the invention is much greater than the stiffness of the plastics sheet from which it is formed. This is in part due to the connecting webs but mainly due to the positioning of the shaped protuberances 5. It has been found that positioning the shaped protuberances 5 such that all straight lines (potential crease, tear or bending lines) projected onto the surface of the packaging sheet must cut through the shaped protuberances (in addition to the gaps between the shaped protuberances) increases the resistance of the packaging sheet to bending. This is because the potential bending line is not able to lie in a flat plane but is forced into a tortuous path along the top surfaces of the shaped protuberances, up or down the side walls of the shaped protuberances and across the gaps between the shaped protuberances. The fact that the side walls 7 of shaped protuberances are slanted or rounded also assists in this regard as it increases the chance that any potential bending line will pass though the shaped protuberances. Provision of the connecting webs 6 also improves resistance to formation of fold lines which find it difficult to propagate through the walls of the webs. Arranging the webs such that all straight lines projected onto the surface of the packaging sheet also cut through at least some of the webs will further improve the ability of the packaging sheet to resist bending.

It is also important to be easily able to cut the packaging material at any required position in a straight line. The particular embodiment shown in FIGS. 1 to 4 accomplishes this through the previously mentioned connecting webs 6. The connecting webs 6 and the cross-bar and upright parts of the "T" shaped shaped protuberances 5 effectively form guiding channels which guide a cutting blade through the packaging sheet. The guiding channels allow the packaging sheet to be easily cut in either of two perpendicular directions while it is much more difficult to cut the packaging sheet at any other angle.

Figure 5:
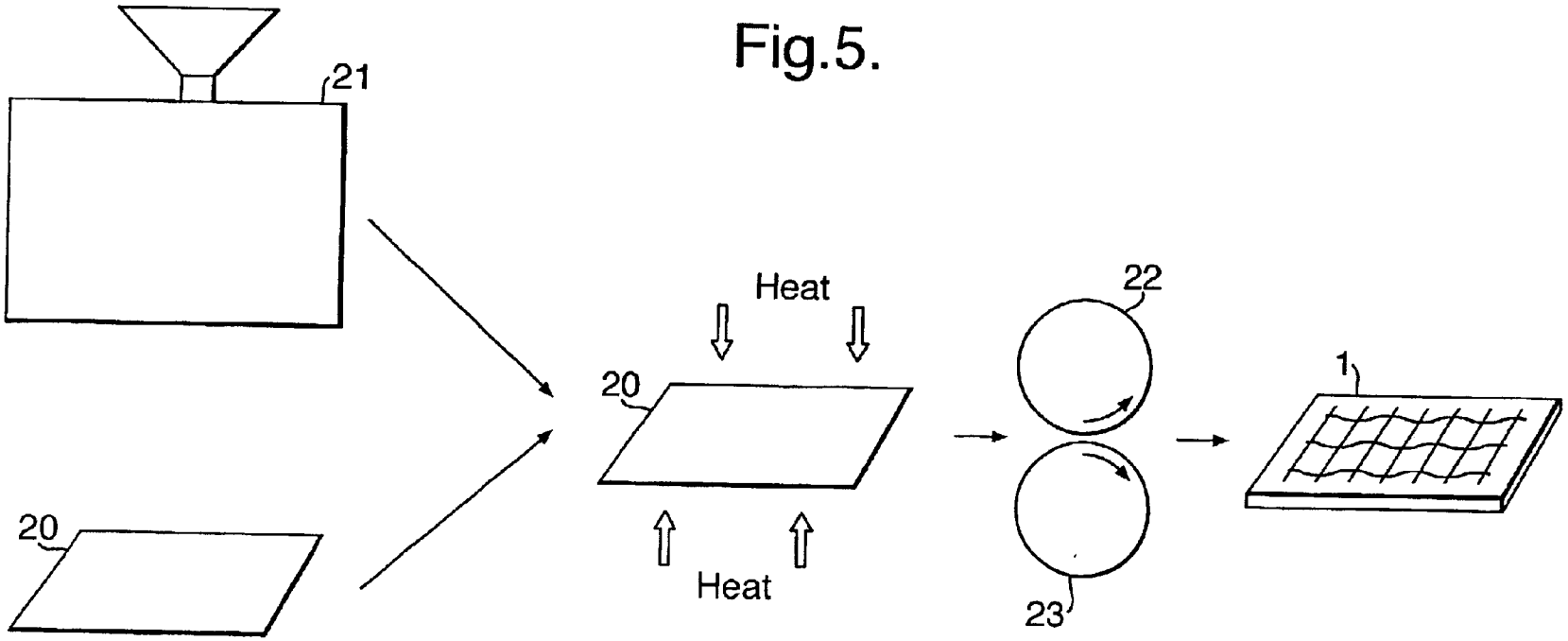
FIG. 5 is a schematic flow diagram showing the main steps in producing the protective packaging sheet of FIG. 1.

With reference now to FIG. 5, the main steps in an example production line for producing the packaging sheet material according to the present invention are shown.

As previously mentioned, thin plastics sheet material 20, which may be either discrete sheets or continuous rolls having a nominal thickness of for example 0.5 mm or 1 mm, is shaped or moulded into the finished plastics packaging sheet 1. The production line could commence with a plastics sheet forming machine 21 fed by raw plastics material such as recycled pellets or alternatively the plastics sheets could be obtained directly from a supplier. Where the plastics sheet is not manufactured "on-site", it is necessary to heat the sheet to a suitable moulding temperature such as its glass transition temperature (for example, 100 to 150° C. for polyethylene). The temperature must be sufficient to allow the sheet to be flexible enough to be deformed into shape without returning to its original shape during cooling or breaking during deformation. Where the plastics sheet is formed "on site" it is anticipated that the sheet will be sufficiently heated during formation to allow suitable moulding to take place without the need for additional heating. It has been found that the thickness of the finished packaging sheet should be less than or equal to about 5 times the thickness of the plastics sheet from which it is formed, any thicker and the desired structural properties are not maximised and there is a risk of damaging the plastics sheet.

Once heated, the plastics sheet is then passed between two embossing rollers 22 and 23 which rotate in opposite directions. At least one of the embossing rollers is provided with a solid embossed surface pattern while the other roller may either be provided with the inverse solid embossed surface pattern (that is, male and female rollers to produce a packaging sheet with an embossed pattern and a constant cross-sectional thickness), a solid cylindrical surface or may be covered in a soft "rubberised" material which will effectively deform to the contours of the embossed roller to follow the embossed roller's pattern. Accordingly, the packaging sheet may be produced with only one side embossed and the other flat (which is not preferred as the sheet then has a preferred orientation), both sides embossed with different patterns or both sides embossed with one side being the inverse of the other.

As the embossing rollers are operated their temperature will increase and it may be necessary to provide a cooling system to the rollers to keep them within a suitable operating range. The preferred operating temperature of the embossing rollers 22 and 23 is around 125° C. and below the temperature of the plastics sheet 20 so that the plastics sheet is cooled and the pattern "frozen" into the plastics sheet upon contact with the rollers.

The width of the plastics sheet and the packaging sheet formed therefrom could be the same as the width of embossing rollers 22 and 23. Alternatively, the length of the rollers may be much less than the width of the sheet and therefore the sheet may need to be aligned and then passed through the embossing rollers a number of times in order to produce the embossed pattern over its entire surface.

In use, sheets or rolls of the packaging sheet material 1 are cut into length/shape and fixed around an object to be packaged. In the case of a steel roll, a length of the packaging sheet is fixed around the circumference of the roll as well as circular or donut shaped pieces being fixed to either end. Adjacent edges of packaging sheet may be fixed together by, for example, welding or suitable adhesive tape. Steel bands may be wrapped around the packaging sheet to hold it in position. If discrete packaging sheets are stacked, the embossed pattern shown in FIGS. 1 to 4 has the additional benefit that the front surface of one sheet is able to nest or interlock with the adjacent rear surface of another sheet to a depth of about 1.5 mm thereby minimising the height of the stack.

A similar procedure is followed in packaging a stack of rectangular cut sheets of metal wherein lengths of packaging sheet material 1 are cut to fit the top, bottom and sides of the stack and the adjacent edges adhered together. The packaged stack of metal sheets may then be wrapped in steel bands.

Testing has been carried out on packaging sheets manufactured according to the present invention from both 0.5 mm and 1.0 mm nominal thickness polyethylene sheet material. The results show that a 0.5 mm nominal thickness sheet of HDPE made into a packaging sheet according to the present invention will require a pressure of up to 2.69 MPa (390 lbf/in$^2$) before the packaging sheet will become totally compressed (that is, back tot he nominal sheet thickness). This is highly desirable as it shows that even under extreme loading, the packaging sheet according to the present invention will be able to maintain a gap between the load and, for example, the ground. A 1.0 mm nominal thickness sheet of HDPE made into a packaging sheet according to the present invention will require up to 3.45 MPa (500 lbf/in$^2$) before total compression occurs. Furthermore, it was found that 48 hours after total compression and removal of the load, the 0.5 mm nominal thickness specimens regained around 70% of their original embossed thickness while 1.0 mm nominal thickness specimens regained around 80% of their original embossed thickness.

An alternative embodiment of the present invention may be used for packaging and protecting lighter loads. Preferably the alternative embodiment is embossed with a surface pattern as in the previous embodiment to provide maximal rigidity, compression resistance and resistance to bending but the raw material from which this embodiment is produced is preferably a rigid foam such as foamed polypropylene having a thickness of for example 1 to 1.5 mm. This alternative embodiment has improved thermal insulating properties so could be used in transporting frozen or cooled foods for example. Alternatively, two separate sheets, one of insulating foamed material and one of polyethylene or polypropylene could be fed between the embossing rollers 22 and 23 simultaneously.

Figure 6:
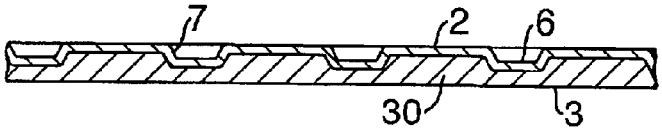
FIG. 6 is a cross-sectional view similar to FIG. 3 through a packaging sheet according to an alternative embodiment of the present invention.
Figure 7:
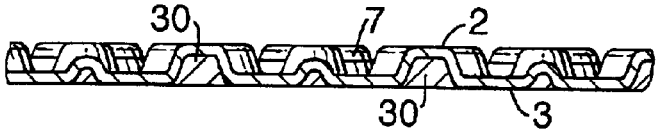
FIG. 7 is a cross-sectional view similar to FIG. 4 through the packaging sheet of FIG. 6.
Figure 8:
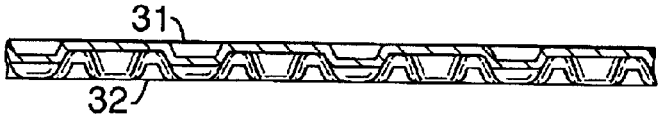
FIG. 8 is a cross-sectional view similar to FIGS. 3 and 6 through a packaging sheet according to a further alternative embodiment of the present invention.
Figure 9:
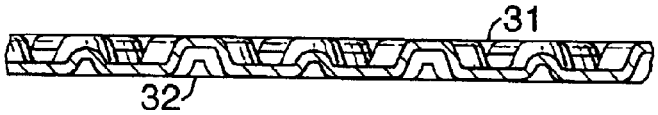
FIG. 9 is a cross-sectional view similar to FIGS. 4 and 7 through the packaging sheet of FIG. 8.

In order to further improve the thermal resistance and structural properties of either embodiment of the packaging sheet, a thin plastics (for example polyethylene or polypropylene) sheet 31, 32 could be laminated to either the front and/or rear surface thereby trapping a layer of substantially stagnant air between the packaging sheet and the thin plastics sheet(s) as shown in FIGS. 8 and 9. Alternatively the space between the sheets could be filled with a suitable insulating foam. A further alternative is shown in FIGS. 6 and 7 without the additional thin plastics sheet but wherein insulating foam 30 fills the depressions in surface 3 of the packaging sheet so that surface 3 is now effectively flat. Of course, the depressions in surface 2 could alternatively or additionally be filled with foam to flatten surface 2.

By including a flat surface, these embodiments provide a convenient surface on which information or advertising may be printed. Furthermore, by trapping air or foam between the embossed sheet and the thin laminated sheet, the compression and impact resistance and thermal insulating properties of the packaging sheet are improved.

Accordingly, at least in the particular embodiments described, the present invention provides a lightweight, durable, rigid and tough packaging material. The packaging sheet according to at least some embodiments of the invention may also easily be cut and is recyclable.

I claim:

1. A protective packaging sheet, consisting of a single material layer having a repeating pattern, the repeating pattern comprising:

shaped protuberances juxtaposed with each other to provide a valley around each of said shaped protuberances, the shaped protuberances being positioned in such a way that every straight line projected onto said sheet cuts through at least one of the shaped protuberances; and connecting webs connecting adjacent said shaped protuberances, said connecting webs being located at a middle level between tops of the shaped protuberances and bottoms of the valleys;

wherein the repeating pattern is present in an upper surface of said packaging sheet, said packaging sheet further having an opposite, lower surface including another repeating pattern which is the inverse of the repeating pattern in upper surface.

2. A protective packaging sheet as claimed in claim 1, wherein some of the connecting webs extend in a first direction and others extend in a second direction perpendicular to the first direction.

3. A protective packaging sheet as claimed in claim 1, wherein the shaped protuberances are tessellatable.

4. A protective packaging sheet as claimed in claim 1, wherein said material is thermoplastics, and a distance between uppermost and lowermost levels of said sheet is less than or equal to about 5 times a thickness of said material layer.

5. The protective packaging sheet of claim 1, wherein an initial thickness of said sheet is defined as a distance between outermost portions on opposite sides thereof when no load is applied on said sheet, said material layer having an elasticity sufficient to allow said sheet to regain at least 70% of the initial thickness after said sheet being completely flattened.

6. The protective packaging sheet of claim 1, wherein an initial thickness of said sheet is defined as a distance between outermost portions on opposite sides thereof when no load is applied on said sheet, said material layer having an elasticity sufficient to allow said sheet to regain from about 70 to about 80% of the initial thickness after said sheet being completely flattened.

7. A protective packaging sheet of claim 1, being entirely made of thermoplastic material.

8. A protective packaging sheet of claim 1, being entirely made of hardened thermoplastic material.

9. A protective packaging sheet, comprising a material layer having a repeating pattern therein;

the repeating pattern comprising shaped protuberances juxtaposed with each other to provide a gap around each of said shaped protuberances, the shaped protuberances being positioned in such a way that every straight line projected onto said sheet cuts through at least one of the shaped protuberances;

wherein the gaps between the shaped protuberances are fully filled with insulating foam;

said foam defines, at least partially, a planar contacting face of said sheet; and said planar contacting face extends substantially throughout an entire area of said sheet.

10. A protective packaging sheet as claimed in claim 9, wherein each of the shaped protuberances comprises a top surface atop side walls which are rounded, beveled or sloped relative to a direction perpendicular to a plane of the packaging sheet.

11. The protective packaging sheet of claim 10, wherein the top surfaces of said shaped protuberances together with said foam filled in said gaps define the planar contacting face.

12. The protective packaging sheet of claim 9, wherein said foam overfills said gaps and defines entirely said planar contacting face.

13. The protective packaging sheet of claim 11, further comprising printed indicia on said planar contacting face.

14. The protective packaging sheet of claim 9, wherein said sheet has a compression strength sufficient to sustain a pressure of about 57 lbf/in2 without being flattened.

15. The protective packaging sheet of claim 9, wherein said sheet has a compression strength sufficient to sustain a pressure of from about 390 to less than about 500 lbf/in2 without being totally flattened.

16. A protective packaging sheet, comprising a material layer having a repeating pattern therein;

the repeating pattern comprising shaped protuberances juxtaposed with each other to provide a gap around each of said shaped protuberances, the shaped protuberances being positioned in such a way that every straight line projected onto said sheet cuts through at least one of the shaped protuberances;

wherein the gaps between the shaped protuberances are filled with insulating foam;

said foam defines, at least partially, a planar contacting face of said sheet;

said planar contacting face extends substantially throughout an entire area of said sheet; and said foam is presented on both opposite sides of said material layer.

17. A protective packaging sheet, comprising a material layer having a repeating pattern therein;

the repeating pattern comprising shaped protuberances juxtaposed with each other to provide a gap around each of said shaped protuberances, the shaped protuberances being positioned in such a way that every straight line projected onto said sheet cuts through at least one of the shaped protuberances;

wherein the gaps between the shaped protuberances are filled with insulating foam;

said foam defines, at least partially, a planar contacting face of said sheet;

said planar contacting face extends substantially throughout an entire area of said sheet; and said material layer is made of a hardened thermoplastic.

18. A protective packaging sheet, consisting of a single material layer having a repeating pattern, the repeating pattern comprising:

shaped protuberances juxtaposed with each other to provide a valley around each of said shaved protuberances, the shaved protuberances being positioned in such a way that every straight line projected onto said sheet cuts through at least one of the shaped protuberances; and connecting webs connecting adjacent said shaved protuberances, said connecting webs being located at a middle level between toys of the shaved protuberances and bottoms of the valleys;

wherein said material layer is made of hardened thermoplastic.

19. The protective packaging sheet of claim 18, wherein said sheet has a compression strength sufficient to sustain a pressure of about 57 lbf/in2 without being flattened.

20. The protective packaging sheet of claim 18, wherein said sheet has a compression strength sufficient to sustain a pressure of from about 390 to less than about 500 lbf/in2 without being totally flattened.

21. The protective packaging sheet of claim 18, wherein said material layer has a material thickness of from about 0.5 to about 1 mm.

22. A protective packaging sheet, comprising a material layer that is shaped to have a repeating pattern, wherein the repeating pattern comprises shaped protuberances juxtaposed with each other to provide a valley around each of said shaped protuberances, the shaped protuberances being positioned in such a way that every straight line projected onto said sheet cuts through at least one of the shaped protuberances;

each of said shaped protuberances has a top and at least one side wall extending downwardly from the top and ending at a bottom of the respective valley surrounding said shaped protuberance, said repeating pattern further comprising connecting webs connecting adjacent said shaped protuberances, said connecting webs being located at a middle level between the tops of the shaped protuberances and the bottoms of the valleys; and a number of the connecting webs and the shaped protuberances being connected by said number of the connecting webs are aligned to define a straight cutting line which does not cut through the bottom of any of said valleys, thereby allowing said sheet to be cut along said straight cutting line easier than alone any other line which cuts through the bottom of at least one of the valleys.

23. The protective packaging sheet of claim 22, wherein the top surfaces of said shaped protuberances together define a top contacting surface of said sheet, said sheet further having a bottom contacting surface downwardly spaced from said top contacting surface by a distance greater than a material thickness of said thermoplastic layer.

24. The protective packaging sheet of claim 23, further comprising an additional material layer laminated to said thermoplastic layer and defining the bottom contacting surface.

25. The protective packaging sheet of claim 24, wherein said additional material layer defines entirely the bottom contacting surface which is planar.

26. The protective packaging sheet of claim 24, further comprising air trapped between said thermoplastic layer and said additional material layer.

27. The protective packaging sheet of claim 25, further comprising air trapped between said thermoplastic layer and said additional material layer.

28. The protective packaging sheet of claim 22, wherein said sheet has a compression strength sufficient to sustain a pressure of about 57 lbf/in2 without being flattened.

29. The protective packaging sheet of claim 22, wherein said thermoplastic layer has a material thickness of from about 0.5 to about 1 mm.

30. A protective packaging sheet, comprising a material layer that is shaped to have a repeating pattern, wherein the repeating pattern comprises shaped protuberances juxtaposed with each other to provide a valley around each of said shaped protuberances, the shaped protuberances being positioned in such a way that every straight line projected onto said sheet cuts through at least one of the shaped protuberances;

the material layer is made of a thermoplastic that has a sufficient strength to maintain the repeating pattern when no external force is acting on said thermoplastic;

each of said shaped protuberances has a top and at least one side wall extending downwardly from the top and ending at a bottom of the respective valley surrounding said shaped protuberance, said repeating pattern further comprising connecting webs connecting adjacent said shaped protuberances, said connecting webs being located at a middle level between the tops of the shaped protuberances and the bottoms of the valleys;

the ton surfaces of said shaped protuberances together define a top contacting surface of said sheet, said sheet further having a bottom contacting surface downwardly spaced from said top contacting surface by a distance greater than a material thickness of said thermoplastic layer; and an initial thickness of said sheet is defined as the distance between said contacting surfaces when no load is applied on said sheet, said thermoplastic layer having an elasticity sufficient to allow said sheet to regain at least 70% of the initial thickness after said sheet being completely flattened.

31. A protective packaging sheet of claim 22, wherein said material layer is made of hardened thermoplastic.

32. A protective packaging sheet of claim 22, wherein said protuberances are T-shaped in plan view.

33. A protective packaging sheet, consisting of a single material layer having a repeating pattern, the repeating pattern comprising:

shaped protuberances juxtaposed with each other to provide a valley around each of said shaped protuberances, the shaped protuberances being positioned in such a way that every straight line projected onto said sheet cuts through at least one of the shaped protuberances; and connecting webs connecting adjacent said shaped protuberances, said connecting webs being located at a middle level between tops of the shaped protuberances and bottoms of the valleys;

wherein a number of the connecting webs and the shaped protuberances being connected by said number of the connecting webs are aligned to define a straight cutting line which does not cut through the bottom of any of said valleys, thereby allowing said sheet to be cut along said straight cutting line easier than along any other line which cuts through the bottom of at least one of the valleys.

34. The protective packaging sheet of claim 33, wherein the connecting webs and the shaped protuberances of said repeating pattern define a first group of said straight cutting lines extending in parallel in a first direction and a second group of said straight cutting lines extending in parallel in a second direction perpendicular to the first direction.

* * * * *